United States Patent [19]

Röck et al.

[11] Patent Number: 5,056,879

[45] Date of Patent: Oct. 15, 1991

[54] PULL-OUT GUIDE ASSEMBLY FOR DRAWERS OR THE LIKE

[75] Inventors: Erich Röck; Reinhard Mäser, both of Höchst, Austria

[73] Assignee: Julius Blum Gesellschaft m.b.H., Höchst, Austria

[21] Appl. No.: 530,393

[22] Filed: May 30, 1990

[30] Foreign Application Priority Data

Jun. 2, 1989 [AT] Austria ..... A 1342/89

[51] Int. Cl.[5] ..... A47B 88/00

[52] U.S. Cl. ..... 312/348; 312/319

[58] Field of Search ..... 312/341.1, 333, 348, 312/330.1, 319

[56] References Cited

U.S. PATENT DOCUMENTS 3,521,939 7/1970 Fall et al. ..... 312/333 X 4,183,596 1/1980 Greene et al. ..... 312/333

*Primary Examiner*—Joseph Falk

*Attorney, Agent, or Firm*—Wenderoth, Lind & Ponack

[57] ABSTRACT

A pull-out guide assembly for use on each of opposite sides of a drawer includes a pull-out rail mounted on the drawer and a supporting rail mounted on a furniture body. Rollers are arranged between running flanges of the rails. The running flanges of the rails are inclined downwardly towards the rear. Thus, when the drawer is in the extreme front position of a path of extraction, it is acted upon to move in the closing direction by a horizontal force component. At the same time, the drawer is held in such front position by a locking device.

14 Claims, 2 Drawing Sheets

PULL-OUT GUIDE ASSEMBLY FOR DRAWERS OR THE LIKE

FIELD AND BACKGROUND OF THE INVENTION

The present invention relates to a pull-out guide assembly for use on each of opposite sides of a drawer or the like and including a pull-out rail mounted on the side of the drawer and a supporting rail mounted on the side of a furniture body, rollers and/or slides being arranged between running flanges of the rails, and a locking device for, when the drawer is in an extreme front position of a path of extraction from the body and is acted upon in a closing direction by a horizontal force component, holding the drawer in such front position.

To prevent a drawer which has been pushed into a furniture body without care from projecting therefrom, it is known to provide the rails of the pull-out guide assembly with so-called run-in means. To this end it is generally provided that running flanges of the supporting rails are, in rear regions thereof, inclined downwardly towards the rear. When the rollers of the drawer and of the pull-out rail reach this inclined region, the drawer is caused to move into the furniture body by the weight of the drawer.

Further, it is known to provide a drawer with locking means formed, for example, by a tilting segment which is acted upon by a spring, such locking means holding the drawer in its pushed-in position and pulling the drawer into its rear end position by the spring force.

It is the disadvantage of the afore-mentioned means that they become effective only when the drawer has been moved substantially into its pushed-in position.

SUMMARY OF THE INVENTION

It is the object of the invention to provide an improved pull-out guide assembly of the afore-mentioned type, wherein the drawer, when it has been moved from its front end position, will always be fully closed, i.e. moved into its rear end position in the furniture body.

According to the invention, this object is achieved in that the locking device is formed by a pivot member which is mounted on the side of the drawer, preferably on a pull-out rail thereof, and abuts in the extreme front position of the drawer against a braking flange of a supporting rail. The pivot member is sector-shaped and has a circularly arced edge which contacts the supporting rail and which is elastically deformable.

One embodiment of the invention provides that the drawer is acted upon by a spring. Such spring advantageously will be arranged between a pull-out rail and a supporting rail. In principle, it would also be possible to provide a motor, for example a linear motor. The basic idea of the invention is, as already mentioned, that when the drawer is in the extracted position it is continuously acted upon by a force component which is directed horizontally to the rear, and that such force component in the extreme front position of the drawer, is rendered ineffective by the locking device.

A particularly good clamping effect is obtained due to the sector shape of the pivot member and due to the elastic deformability of the circularly arced edge of the pivot member that contacts the supporting rail and is deformed thereby.

Further, it is advantageously provided that the supporting rail is mounted on the body side wall by means of screws or the like which are aligned in a straight line that extends at an angle to a running flange or the braking flange of the supporting rail. Thus, the supporting rail can be mounted in a conventional manner. Above all, the fastening holes at the drawer side walls can be drilled at pre-set intervals of an automatic drilling machine.

BRIEF DESCRIPTION OF THE DRAWINGS

In the following the invention will be described in more detail with reference to the accompanying drawings, in which.

DETAILED DESCRIPTION OF THE INVENTION

Figure 1:
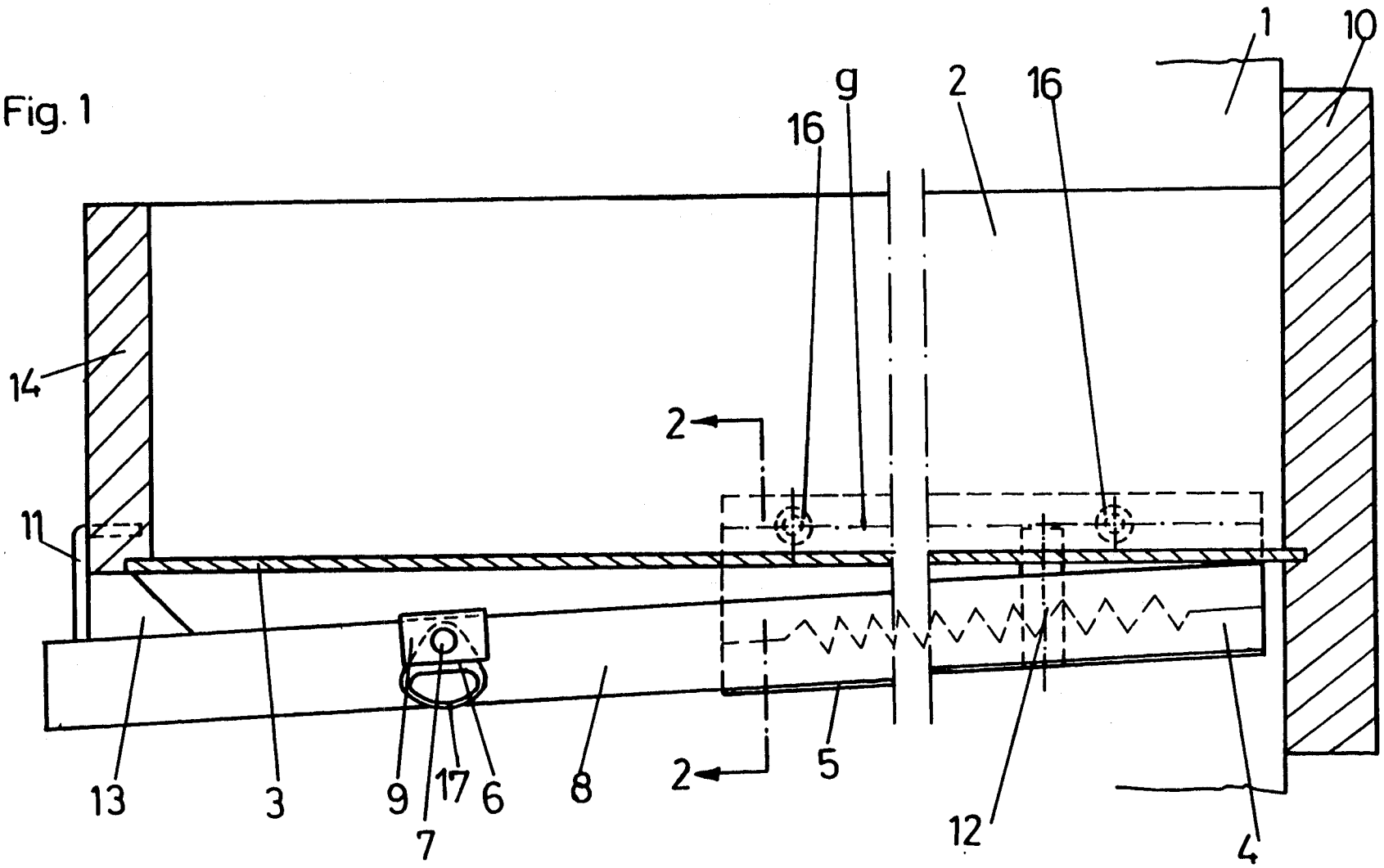
FIG. 1 shows a longitudinal sectional view of a drawer with a pull-out guide assembly according to the invention.
Figure 2:
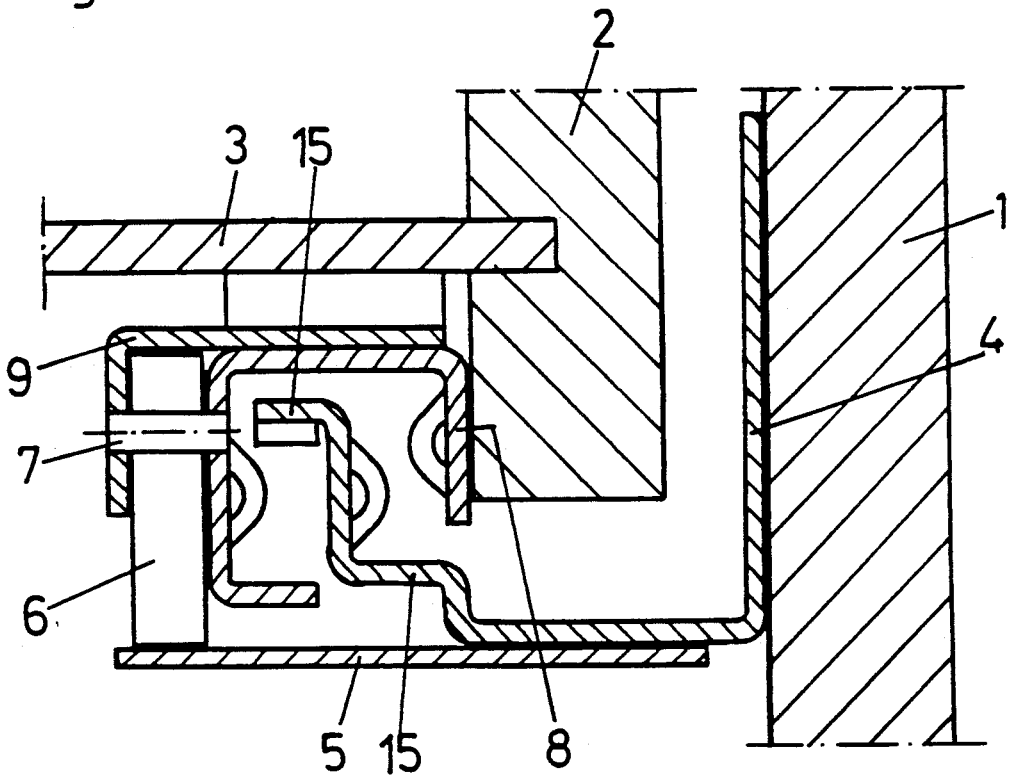
FIG. 2 is a cross-sectional view of a corner region of the drawer and of the pull-out guide assembly according to the invention taken along line 2—2 in FIG. 1.

In the drawings, a furniture body side wall is designated with reference number 1, a drawer side wall with 2 and a drawer bottom with 3. The drawings shown a pull-out guide assembly at one side of the drawer only, and the other side is analogous.

The pull-out guide assembly comprises a pull-out rail 8 mounted on drawer side wall 2 and a supporting rail 4 mounted on the body side wall 1. Between rails 8, 4, rollers or slides are arranged in a manner known per se and serve for the transmission of load. Such rollers or slides are, however, not shown in the drawings since they are not in and of themselves part of the subject matter of the present invention. Running carriages with rollers or running ball members also may be provided. It is only essential that guiding is sufficiently smooth and that the force component which acts towards the rear is not rendered ineffective by friction.

As can be seen from FIG. 1, the pull-out rail 8 is arranged in a manner inclined with respect to the drawer bottom 3 and to the horizontal. That is, a front end of rail 8 adjacent a front plate 10 of the drawer is higher than a rear end of rail 8 which is adjacent to a rear wall 14 of the drawer. The pull-out rail has at its rear end a base member 13 which serves as a spacer member for the drawer. At the rear, the pull-out rail 8 is engageable with the rear wall 14 of the drawer by means of a fastening hook 11. At the front, the pull-out rail 8 has a fastening bolt 12 that is aligned parallel to the front plate 10 and that extends into a hole in the drawer side wall 2.

The locking device is arranged at the rear third of the pull-out rail 8. The locking device comprises a pivot member 6 which is held at a bearing block 9 by means of a bearing bolt 7.

The supporting rail 4 is half as long as the pull-out rail 8, is fastened to the front portion of the furniture side wall 1, and has running flanges 15 which are downwardly inclined to the rear and a braking flange 5 which extends parallel to flanges 15. The supporting rail 4 is fastened to wall 1 by means of fastening screws which extend through holes 16 which are located on a horizontal straight line g that extends at an angle to the braking flange 5 and to the running flanges 15. Thus, the supporting rail can be mounted to the furniture side wall 1 in a manner known per se, and the fastening holes can also be drilled to be aligned in a straight line which is perpendicular to the front edge of the furniture side wall 1.

Because of the inclined arrangement of the running flanges 15 and of the pull-out rail 8, the weight of the drawer itself tends to move the drawer rearwardly into the furniture body.

Figure 3:
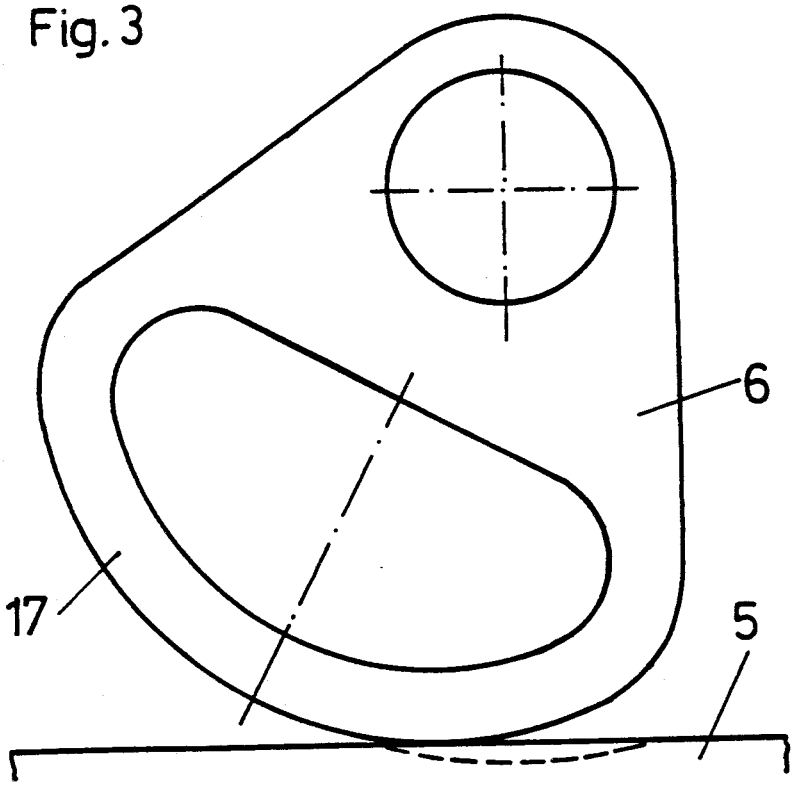
FIG. 3 is a diagrammatic side view of a pivot member.

The pivot member 6 is sector-shaped and has a circularly arced edge 17 which is deformable. In FIG. 3, the dimension of deformability of edge 17 upon contact against the braking flange 5 is shown by a broken line. The broken line shows to which extent the pivot member 6 would project into the braking flange 5 if edge 17 were not deformable.

When the drawer is pulled out, the pivot member 6 of the locking device eventually comes into contact with the braking flange 5 of the supporting rail 4 and clamps against flange 5 at the extreme front position of the drawer. When it is desired to close the drawer, slight pressure against the drawer is sufficient to overcome the clamping effect of the pivot member 6. This is possible because of the resilience of the pivot member 6 which, for example, may be made of plastics material. When the clamping effect between the pivot member 6 and the braking flange 5 has become ineffective, the drawer is moved into the furniture body by the weight of the drawer.

Instead of the inclined rails 4, 8 to achieve the effect of causing the drawer to move inwardly, a spring acting between the furniture body or the supporting rail and the drawer or the pull-out rail could be provided, as shown schematically in FIG. 1.

What is claimed is:

1. A pull-out guide assembly for use on each of opposite sides of a drawer that is movable into and out of a furniture body, said assembly comprising:

a supporting rail to be mounted on the furniture body and a pull-out rail to be mounted on the drawer, such that said pull-out rail is slidable relative to said supporting rail upon movement of the drawer into and out of the furniture body;

means for imparting to the drawer and to said pull-out rail a horizontal force component tending to move the drawer and said pull-out rail in a closing direction into the furniture body and inwardly along said supporting rail, respectively; and locking means for, when the drawer and said pull-out rail are moved to a fully withdrawn position, maintaining the drawer and said pull-out rail in said fully withdrawn position against said horizontal force component, said locking means comprising a sector-shaped pivot member mountable on one of the drawer or said pull-out rail, said pivot member having a circularly arched edge that is elastically deformable and that contacts a portion of said supporting rail in said fully withdrawn position and is deformed thereby.

2. An assembly as claimed in claim 1, wherein said pivot member is pivotally mounted on said pull-out rail.

3. An assembly as claimed in claim 1, wherein said portion of said supporting rail comprises a braking flange of said supporting rail.

4. An assembly as claimed in claim 1, wherein said force component imparting means comprises a spring.

5. An assembly as claimed in claim 4, wherein said spring acts between said supporting rail and said pull-out rail.

6. An assembly as claimed in claim 1, wherein said force component imparting means comprise running flanges of said supporting and pull-out rails extending in downwardly and rearwardly inclined directions.

7. An article of furniture comprising a furniture body, a drawer movable into and out of said furniture body, and pull-out guide assemblies on opposite sides of said drawer for guiding movement of said drawer relative to said furniture body, each said pull-out guide assembly comprising:

a supporting rail mounted on said furniture body and a pull-out rail mounted on said drawer, such that said pull-out rail is slidable relative to said supporting rail upon movement of said drawer into and out of said furniture body;

means for imparting to said drawer and to said pull-out rail a horizontal force component tending to move said drawer and said pull-out rail in a closing direction into said furniture body and inwardly along said supporting rail, respectively; and locking means for, when said drawer and said pull-out rail are moved to a fully withdrawn position, maintaining said drawer and said pull-out rail in said fully withdrawn position against said horizontal force component, said locking means comprising a sector-shaped pivot member mounted on one of said drawer or said pull-out rail, said pivot member having a circularly arced edge that is elastically deformable and that contacts a portion of said supporting rail in said fully withdrawn position and is deformed thereby.

8. An article of furniture as claimed in claim 7, wherein said pivot member is pivotally mounted on said pull-out rail.

9. An article of furniture as claimed in claim 7, wherein said portion of said supporting rail comprises a braking flange of said supporting rail.

10. An article of furniture as claimed in claim 7, wherein said force component imparting means comprises a spring.

11. An article of furniture as claimed in claim 10, wherein said spring acts between said supporting rail and said pull-out rail.

12. An article of furniture as claimed in claim 7, wherein said force component imparting means comprise running flanges of said supporting and pull-out rails extending in downwardly and rearwardly inclined directions.

13. An article of furniture as claimed in claim 12, wherein said supporting rail is mounted on said furniture body by means of connection members aligned in a straight line extending at an angle to said running flanges.

14. An article of furniture as claimed in claim 13, wherein said straight line extends horizontally.

* * * * *